United States Patent [19]

Elfgen

[11] Patent Number: 4,688,856

[45] Date of Patent: Aug. 25, 1987

[54] ROUND CUTTING TOOL

[76] Inventor: Gerd Elfgen, Theisenkreuzweg 10, D-5303 Bornheim 3, Fed. Rep. of Germany

[21] Appl. No.: 791,686

[22] Filed: Oct. 28, 1985

[30] Foreign Application Priority Data

Oct. 27, 1984 [DE] Fed. Rep. of Germany ..... 3439491

[51] Int. Cl.[4] ..... E21C 35/18

[52] U.S. Cl. ..... 299/79; 30/168

[58] Field of Search ..... 30/168, 169, 272 R, 30/272 A, 367; 173/90, 94, 97, 100; 279/19.5, 19.6; 299/79, 86, 91

[56] References Cited

U.S. PATENT DOCUMENTS 2,997,024 8/1961 McLean ..... 279/19.5

4,065,185 12/1977 Elders ..... 299/91 X

FOREIGN PATENT DOCUMENTS 2092205 8/1982 United Kingdom ..... 299/91

*Primary Examiner*—E. R. Kazenske
*Assistant Examiner*—Michael D. Folkerts
*Attorney, Agent, or Firm*—Diller, Ramik & Wight

[57] ABSTRACT

The round cutting tool (10) comprises a substantially cylindrical shank (11), carrying a separately manufactured annular collar (14) slipped subsequently on the shank and abutting against a stop element (13). As a result thereof, material and energy costs are considerably reduced during the production of the round cutting tool because it is not produced in total in one piece in removing material by dressing.

13 Claims, 4 Drawing Figures

ROUND CUTTING TOOL

The invention relates to a round cutting tool to be introduced into a chisel holder of a cutting machine or miller,comprising a chisel shank containing an annular collar as a support at the aperture of the chisel holder and a chisel bit at the front end.

Road millers used to remove or roughen up worn road surfaces are provided with round cutting tools similar to those utilized in mining which are mounted in cutting machines. The chisel holders adapted to receive the round cutting tools are fixed at a wheel which moves along the surface to be removed so that the chisel bits of the round cutting tools are usually attacking said surface and acting thereon at an acute angle. As a result thereof, the round cutting tools are pressed axially against the stop face of the chisel holder aperture and turned about their axis.

The known cutting tools are provided with a shank from which an annular collar projects radially. The rear shoulder of the annular collar is supported by the stop face of the chisel holder. The mass production of said round cutting tools is realised by cold pressing during which process the annular collar is integrally formed with the chisel shank. Only the metal carbide chisel bit is inserted and soldered subsequently in a corresponding aperture at the front end of the chisel shank. If smaller quantities of round chisels are produced, this is effected by chip removal with the use of turning lathes.In that case,a round bar whose diameter is equal to the maximum width of the annular collar is machined to impart to the cutting tool its final contour. As a disadvantage of such a procedure, nearly half the bar material is removed by metal cutting and it is lost as waste. This is uneconomical not only from the material cost viewpoint, but also in view of the energy consumption during machining and in view of the long processing time.

It is the object of the invention to provide a round cutting tool of the above mentioned type which may be produced with a low expenditure of material, energy and working time.

The problem is solved according to the invention in that the chisel shank consists of a substantially cylindrical bar and that the annular collar is produced separately and protected on the bar against its displacement towards the chisel bit.

The annular collar of the round cutting tool of the invention is a separately manufactured element which is slipped subsequently on the substantially cylindrical chisel shank for which a round material may be used that need be treated only sectionwise, for instance at the ends and in the area subsequently receiving a clamping sleeve. A substantial length of the bar material which may constitute sometimes more than half the length of the round cutting tool need not be treated at all. The annular collar may be made from a tube material. Less material will be wasted during the production of the round cutting tool. The machining times are relatively short and the energy consumption required for the treatment of the material is reduced. Further, due to the separate manufacture of chisel shank and annular collar and by the subsequent connection of said elements, the stock-keeping may be restricted.

The annular collar may be fixed at the chisel shank in different ways, for instance by soldering. To this effect, a ring of soldering material may be placed at the butt point between the annular collar and the chisel shank.

The solder is fusing in a furnace and penetrates into the very narrow annular gap between the annular collar and the chisel shank. In one pass through the furnace,it is possible to fix by soldering the annular collar and the chisel bit to the chisel shank.

According to another favorable embodiment of the invention, the annular collar is mounted rotatably on the chisel shank and its front end abuts against a stop element fixed on the chisel shank. In this case, the chisel shank is rotatable relative to the annular collar with the resultant advantage that the chisel shank with the bit secured thereto may even rotate easily if the annular collar has seized the aperture of the chisel holder. Since the round cutting tools are used in very dirty environments, wear and mechanical stress at the chisels as well as at their holders are considerable. Very frequently, the round cutting tool seizes with respect to the holder with a resultant loss of rotatability. As a consequence thereof, wear of the chisel bit is not uniform. Due to the rotatable mounting of the chisel shank relative to the annular collar, it is ensured that the chisel shank may still rotate relative to the holder when the conventional round cutting tools are blocked.

In case of the rotatable mounting, the annular collar is preferably removable from the chisel shank via its rear end. By this means, chisel shanks and annular collars may be delivered and stored separately, and a chisel shank may be fitted optionally with different annular collars which, as to their dimensions and shapes, vary from one another.

A considerable problem involved with cutting machines and millers is the penetration of dirt into the aperture of the chisel holder thus causing between the chisel shank and bore wall a great wear of both elements, such dirt penetration being still favored in that the chisel shank with the annular collar performs slight axial movents relative to the chisel holder during the rotation of the wheel of the cutting machine or miller. Whenever the chisel bit is in use, the chisel shank is pressed by about 1 mm into the bore to spring back again subsequently. Due to said continuous axial "pumping", dirt formed by the material removal and settling in the range of the rear end face of the annular collar is being fed under compression into the bore of the chisel holder. To keep the dirt off the bore, it is recommendable to provide a fit as snugly as possible between the bore and the chisel shank. However, said effect is lost if a certain wear has developed before.

To inhibit penetration of dirt into the bore of the chisel holder, it is further provided according to the invention that the rear end of the annular collar contains an annular undercut to properly receive a conical stop face of the aperture of the chisel holder. Due to the conical stop face, dirt is stripped of the chisel shank and rejected radially to the outside. While the stop face normally forms an undercut of the wall of the chisel holder, its design according to the invention is a conical surface which is tapered to the front. Particles penetrating into the gap between the annular collar and the aperture of the chisel holder are rejected to the outside accordingly.

According to an alternative embodiment, the rear end of the annular collar comprises a radial end face abutting against a radial stop face of the aperture of the chisel holder. Again, dirt is prevented from being pumped into the bore of the chisel holder or it is at least hindered on its way thereto.

To reduce the wear being most obvious in the range of the chisel holder aperture, it is further provided, according to the invention that the aperture of the chisel holder contains a metal carbide insert.

While, with the known round cutting tools, attention must be paid to the fact that the outer diameter of the annular collar is as small as possible, a preferred embodiment of the invention provides at the rear end of the annular collar an annular attachment cooperating with the stop face of the chisel holder aperture, a flange being arranged in advance of the attachment to radially project beyond the latter. Preferably, the front side of the flange is of a conical shape.

The flange forms a dirt fender of a relatively large radially projecting design which is mounted protectively in front of the aperture of the chisel holder thus keeping it free from major amounts of existing dirt.

However, such an annular collar still performs another function. If the aperture of a chisel holder is already worn to a far extent so that a conventional round cutting tool, if mounted in the holder, would have a considerable radial play thus additionally contributing to wear, the attachment of the annular collar of the invention occupies the wear range of the chisel holder aperture while the flange adjoins from the outside the front side of the chisel holder. By this means, the round cutting tool will be reseated firmly with a defined position in the chisel holder.

This is particular important in connection with road millers where the perfect maintenance of the road surface level under production is absolutely necessary. With the use of loosely seated round cutting tools, the desired level of removal may not be maintained with the required accuracy.

Some embodiments of the invention will be explained hereunder in more detail with reference to the drawings.

Figure 1:
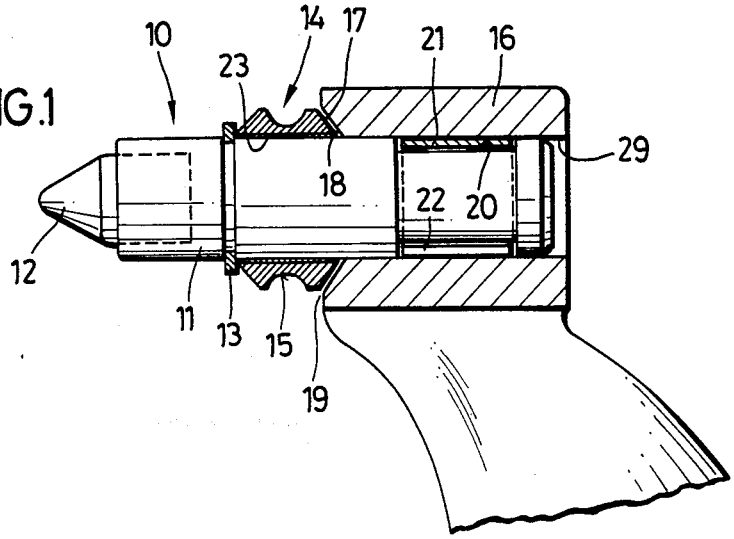
FIG. 1 shows a section view of a first embodiment.

As obvious from the embodiment of FIG. 1, the round cutting tool 10 comprises a substantially cylindrical shank 11 made of a round bar materal. In a bore (unnumbered) provided in the front end of the chisel shank 11, a chisel bit 12 of metal carbide is inserted and fixed by soldering. Shank 11 contains a circumjacent groove (unnumbered) to seat therein a retainer ring as a stop element 13 for the annular collar 14 which includes a bore corresponding to the diameter of the chisel shank 11 and which, from the rearward end of the chisel shank 11 is slipped on the latter to abut with its front end against the stop element 13. In a manner known per se, the annular collar 14 is provided with a lifter groove 15 to apply thereto a chisel lifter with the object of removing the round cutting tool 10 from a chisel holder 16. The rear end face 17 of the annular collar 14 is conical, i.e. it is bevelled rearwardly, and it abuts against a stop face 18 at the front aperture 19 of the chisel holder 16. The abutment face 18 designed as an inner cone is bevelled like the end face 17 so that the end face 17 may snugly adjoin the stop face 18.

The portion of the chisel shank 11 dipping into the bore of the holder 16 is provided with a recess or groove 20 for seating an elastic clamping sleeve 21 which causes a locking between the chisel shank shank 11 and the bore 29. Further, the clamping sleeve 21, in a manner known per se, contains an elongated slot 22. The diameter of the shank 11 is so dimensioned that the chisel shank 11 snugly fits into the bore 29.

The diameter of the chisel shank 11 is constant over its total length with the exception of the groove for the stop element 13 and the groove 20. As stated, the annular collar 14 is slipped on the chisel shank 11 on which it may be freely rotated or fixed by a solder 23.

Figure 2:
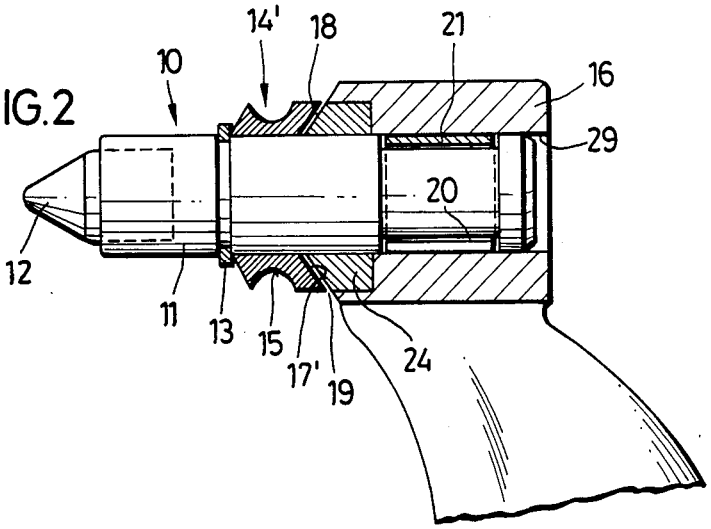
FIG. 2 shows a second embodiment having an undercut at the rear end of the annular collar and a hard metal element in the cutting tool holder.

The round cutting tool 10 shown in FIG. 2 contains a shank 11 similar to that of the tool disclosed in FIG. 1. Basically,the annular collar 14' is of the same design as the annular collar 14, but its rear end face 17' is formed as an inner cone thus resulting in an undercut which is engaged by the conical, forwardly projecting aperture 19 of the chisel holder 16. In the embodiment under consideration, the aperture 19 contains an annular metal carbide insert 24 whose inner face forms the front end of bore 29 and whose front side constitutes the stop face 18 tapered towards the front end. The annular collar 14' being produced separately from the chisel shank 11, it is possible to realize by simple means the rearward end face 17' as an inner cone, i.e. as an undercut.

If, during the operation, the round cutting tool 10 is slightly displaced axially relative to the holder 16, any dirt penetrating into the gap between the end face 17' and the stop face 18 is stripped off and rejected to the outside by the forwardly tapered stop face 18. Further, the annular collar 14' of the embodiment is rotatably mounted on the shank 11. Even if said annular collar 14' seizes the chisel holder 16, so that it cannot rotate any longer, a rotation of the chisel shank 11 about its longitudinal axis is still possible.

Figure 3:
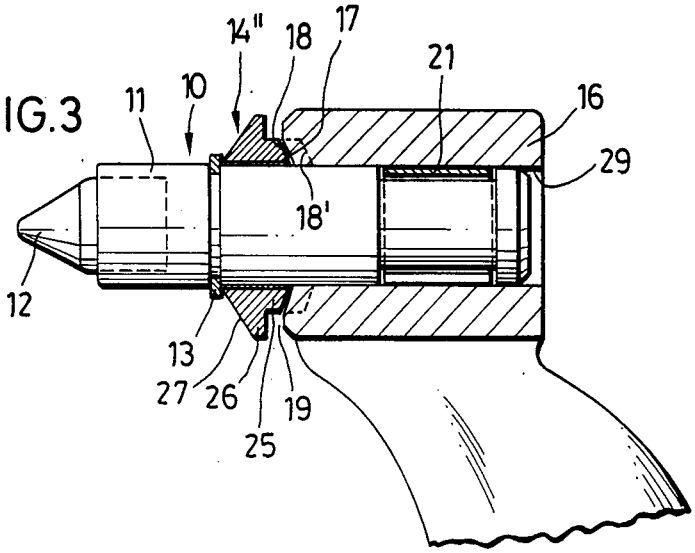
FIG. 3 shows a third embodiment comprising an annular collar with a radially projecting flange and FIG. 4 shows a fourth embodiment in which the radial end face of the annular collar fixed by soldering presses against the cutting tool holder.

FIG. 3 shows a round cutting tool 10 in which the rear end of the annular collar 14" loosely slipped on the chisel shank 11 is provided with an axially projecting attachment 25 whose rear end face 17 is conically tapered to the back to abut against the stop face 18 in the form of an inner cone of the chisel holder 16. In advance of the attachment 25, there is provided an annular flange 26 which radially projects beyond the attachment 25 and whose front side 27 is conical, or tapered to the front end. The inclined front face 27 of flange 26 acts as a dirt fender to ensure that any dirt arriving from the chisel bit 12, is diverted away from the aperture 19 of the chisel holder 16 to the outside so that the amount of dirt and dust that may penetrate into the bore 29 is only low. Moreover, the flange 26 with its radially extending rear side still performs another duty. If the stop face 18 of the aperture 19 is worn by abrasion to assume the dash-lined contour 18',the rear side of the flange 26 adjoins the front side of the chisel holder 16 to realise a large-surface support and to inhibit a further wear of the surface 18'. In order to guarantee a still sufficient rotatability of the chisel shank 11 under said circumstances, the annular collar 14" is mounted rotatably on the shank 11 and it is protected against axial displacements by the stop element 13 only.

In the embodiment of FIG. 3, the round cutting tool 10 may be lifted from the holder 16 by inserting an extraction tool into the gap between the flange 26 and the holder or by effecting blows on the rear end of the chisel shank 11.

The round cutting tool of FIG. 3 may advantageously replace also conventional round cutting tools which have caused the dash-lined contour 18' due to wear in the chisel holder 16. If the round cutting tool of FIG. 3 is introduced into the holder 16, it will be held firmly and free from play thus allowing to exactly maintain the surface level to be produced for instance in case of road milling operations.

Figure 4:
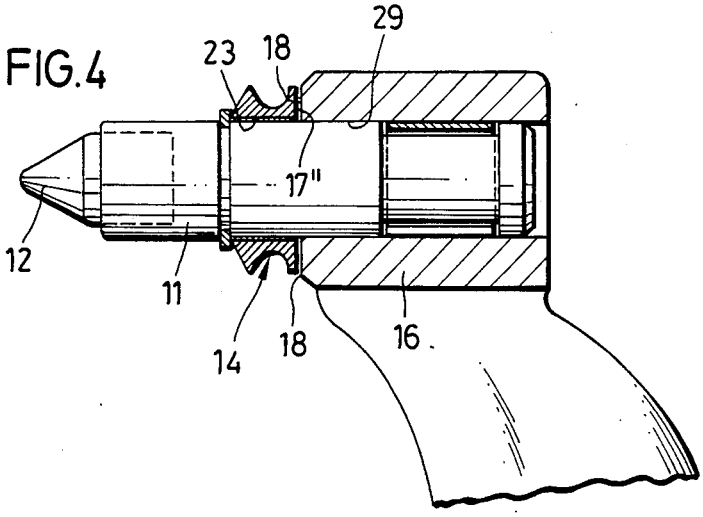

FIG. 4 shows an embodiment of the annular collar 14 subsequently slipped on shank 11 and fixed with a solder 23. Stop element 13 is not absolutely necessary in this case. The rear end side 17'' of the annular collar 14 is radial, i.e. it rectangularly projects from the surface of the chisel shank 11. In this embodiment, the front stop face 18 of the chisel holder 16 is radial as well. Due to the radial extension of surfaces 17'' and 18, pumping of dirt into the chisel holder and into the bore 29 is rendered more difficult.

What is claimed is:

1. A cutting tool adapted to be introduced into a chisel holder of a cutting machine comprising a chisel shank formed by an elongated generally cylindrical body having axially opposite end portions, a separate chisel bit carried by a first of said end portions, a chisel holder, means for connecting a second of said end portions to said chisel holder, a separate annular collar carried by said elongated body between the axially opposite end portions thereof, said annular collar being in axial spaced noncontacting relationship relative to said chisel bit, means for preventing movement of said annular collar in a direction toward said chisel bit, said annular collar having axial end face surface means remote from said chisel bit for axial abuttingly contacting an axially opposing surface of said chisel holder, and said annular collar movement preventing means being a retaining ring.

2. The cutting tool as defined in claim 1 including solder binding said annular collar to said elongated body.

3. The cutting tool as defined in claim 1 wherein said retaining ring is positioned between said annular collar and an annular surface of said shank first end portion axially facing said annular collar, and solder binding said annular collar to said elongated body.

4. The cutting tool as defined in claim 1 wherein said retaining ring is freely rotatable.

5. The cutting tool as defined in claim 1 wherein said retaining ring is positioned between said annular collar and an annular surface of said shank first end portion axially facing said annular collar.

6. The cutting tool as defined in claim 5 wherein said axial end face surface means is a generally frusto-conical surface reducing in diameter in a direction toward said chisel holder.

7. The cutting tool as defined in claim 5 wherein said axial end face surface means is a generally frusto-conical surface increasing in diameter in a direction toward said chisel holder.

8. The cutting tool as defined in claim 5 wherein said axial end face surface means is a generally frusto-conical surface reducing in diameter in a direction toward said chisel holder, and said chisel holder includes a frusto-conical recess generally matingly-receiving said end face frusto-conical surface.

9. The cutting tool as defined in claim 5 wherein said axial end face surface means is a generally frusto-conical surface increasing in diameter in a direction toward said chisel holder, said end face frusto-conical surface defining a frusto-conical recess, and said chisel holder includes a frusto-conical surface generally matingly received in said end face frusto-conical recess.

10. The cutting tool as defined in claim 5 wherein said axial end face surface means is a generally frusto-conical surface increasing in diameter in a direction toward said chisel holder, said end face frusto-conical surface defining a frusto-conical recess, and said chisel holder includes an annular insert having a frusto-conical surface generally matingly recessed in said end face frusto-conical recess.

11. A cutting tool adapted to be introduced into a chisel holder of a cutting machine comprising a chisel shank formed by an elongated generally cylindrical body having axially opposite end portions, a separate chisel bit carried by a first of said end portions, a chisel holder, means for connecting a second of said end portions to said chisel holder, a separate annular collar carried by said elongated body between the axially opposite end portions thereof, said annular collar being in axial spaced noncontacting relationship relative to said chisel bit, means for preventing movement of said annular collar in a direction toward said chisel bit, said annular collar having axial end face surface means remote from said chisel bit for axial abuttingly contacting an axially opposing surface of said chisel holder, and said axial end face surface means being a generally frusto-conical surface increasing in diameter in a direction toward said chisel holder.

12. The cutting tool as defined in claim 11 wherein said end face frusto-conical surface defines a frusto-conical recess, and said chisel holder includes a frusto-conical surface generally matingly received in said end face frusto-conical recess.

13. The cutting tool as defined in claim 11 wherein said end face frusto-conical surface defines a frusto-conical recess, and said chisel holder includes an annular insert having a frusto-conical surface generally matingly recessed in said end face frusto-conical recess.

* * * * *